United States Patent [19]

Spies

[11] 4,369,934

[45] Jan. 25, 1983

[54] HELICAL FILAMENT WINDING APPARATUS

[76] Inventor: Henry J. Spies, P.O. Box 384, Station "B", London, Ontarior, Canada, N6A 4W1

[21] Appl. No.: 231,584

[22] Filed: Feb. 3, 1981

[51] Int. Cl.[3] ..... B65H 54/28; B65H 57/28

[52] U.S. Cl. ..... 242/157.1; 156/169; 242/1; 242/7.21; 242/18 R; 242/158 R; 242/47

[58] Field of Search ..... 242/157.1, 158 R, 158 B, 242/158.4 R, 43 R, 7.15, 7.21, 7.22, 2, 3, 18 R, 18 G, 47; 156/169, 173, 175, 429, 431, 446

[56] References Cited

U.S. PATENT DOCUMENTS

| | | | |
|---|---|---|---|
| 325,813 | 9/1885 | Briggs | 242/157.1 X |
| 3,025,205 | 3/1962 | Young | 156/169 |
| 3,248,063 | 4/1966 | Sheldon et al. | 242/158 R X |
| 3,281,299 | 10/1966 | Shobert | 156/175 |
| 3,499,616 | 3/1970 | McClean | 242/158 R |
| 3,577,294 | 5/1971 | David | 242/3 X |
| 3,586,561 | 6/1971 | Wesch | 156/169 X |
| 3,730,795 | 5/1973 | Medney et al. | 156/169 |
| 3,761,341 | 9/1973 | Kimble | 242/43 R X |
| 3,814,348 | 6/1974 | Johnson | 242/157.1 X |
| 3,861,607 | 1/1975 | Schippers et al. | 242/43R |

FOREIGN PATENT DOCUMENTS

| | | | |
|---|---|---|---|
| 2370669 | 11/1976 | France | 242/157.1 |

*Primary Examiner*—Stanley N. Gilreath

*Attorney, Agent, or Firm*—Berman, Aisenberg & Platt

[57] ABSTRACT

A method and apparatus for use in helical filament winding operations, wherein the filament to be wound is axially displaced a predetermined amount as it is drawn about a traction roller by a driven form or mandrel on which the filament is to be wound, whereby the degree of axial displacement of the filament on the traction roller determines the angle of helical wind on the winding surface. A filament guide is provided comprising a traction roller about which, in operation, the filament to be wound is drawn to rotate the roller. A means is provided which contacts the filament in order to axially displace the filament on the traction roller a predetermined amount with respect to filament input and filament output paths thereby defining the helix angle of wrap on the form. This filament contact means is movable, under force as applied thereon by the filament leaving the roller, between predetermined limits in a direction parallel to the axis of the roller. The guide further comprises means to reverse the axial displacement of the filament when the filament axial displacement means reaches the predetermined limit in each direction, thereby defining the limits of movement of the filament axial displacement means and, as well, the limits of the filament winding on the form. The method and apparatus according to the present invention provides a simple, inexpensive and effective means to provide uniform helical wound filament for a wide variety of applications, such as storage of textile filaments in rolls, production of continuous reinforcement composite pipe and the like.

12 Claims, 5 Drawing Figures

HELICAL FILAMENT WINDING APPARATUS

BACKGROUND OF THE INVENTION

The present invention relates to a method and apparatus for helical filament winding operations, and more particularly relates to apparatus which may be used in such method, for wet and dry winding filament operations.

Filament winding which produces a high degree of fibre orientation is an extremely important industrial technique. Where glass fibre filaments are involved, filament winding produces a high degree of orientation and high glass loading to provide extremely high tensile strengths in the manufacture of hollow, generally cylindrical products such as chemical and fuel storage tanks, pipe, pressure vessels and rocket motor cases. In such industrial applications, special winding machines lay down continuous strands of glass or other reinforcement fibre which has been impregnated with a resin, in a predetermined pattern on an appropriately shaped mandrel, to provide maximum strength in the directions required. When sufficient layers of filament have been applied, the wound mandrel is then cured and the mandrel is then removed. Such filament wound products have the highest strength to weight ratio of any fibre reinforced plastic manufacturing process, and may be accurately machined.

In the present state of the art of helical filament winding over generally cylindrical mandrels, usually requires a filament source, a friction tensioner for the filament, a driven cam-follower guide and a driven winding mandrel. The drive rotates the mandrel which pulls the filament through the cam-follower guide which reciprocates tranversely in a direction parallel to the axis of rotation of the mandrel. U.S. Pat. No. 3,281,299 of Shobert issued Oct. 25, 1966 and U.S. Pat. No. 3,577,294 of David issued May 4, 1971 describe and illustrate examples of such filament winding setups. In present state of the art helical filament winding systems where the filament is wound over generally cylindrical mandrels, the winding ratio between mandrel rotations to traverse is critical to produce a uniform thickness. This ratio is generally locked in by utilizing either timing belt, gears, chains or electronic synchronization techniques. For a particular mandrel circumference, length and required helix angle of wind, the setup is unique. The winding ratio must be an exact non-integer to produce a progressively uniform windup by positioning generally multiple filaments alongside each other and preventing excessive buildup in some areas. The speeds of such operations are generally slow, and complex expensive apparatus is required.

Generally, the filament transverse feed guide is cam activated with a grooved moveable axially cam which itself must be driven to ensure proper transverse location of the guide at any particular time with respect to the filament being wound on the mandrel to ensure proper filament winding on the mandrel.

Other patents of general background interest include U.S. Pat. No. 3,025,205 of Young issued Mar. 13, 1962; U.S. Pat. No. 3,730,795 of Medney et al. issued May 1, 1973 and Canadian Pat. No. 943,931 of Stewart issued Mar. 19, 1974.

It is an object of the present invention to provide a simpler, more economical method and apparatus for guiding filament in helical filament winding operations. It is a further object of the present invention to provide such a guide which will enable high speed filament winding. Yet another object is to provide such a filament guide wherein the helical angle of the filament being wound is fixed solely by the configuration of the guide, and is independent of mandrel dimensions (diameter, length), thereby avoiding tedious setups between different sized mandrels.

SUMMARY OF THE INVENTION

In order to understand the present invention, some background theory will be helpful.

If a filament is drawn over a fixed, non-rotating cylinder, the input and output tension ($t_i$ and $t_o$) relationship is described by the classical exponential capstan formula $t_o = t_i e^{\mu b}$ where $\mu$ is the coefficient of friction between the filament and cylinder, b is angle of wrap in radians and e is the natural exponential constant (e=2.71828. . . ).

When the cylinder is released the filament will grip and rotate the cylinder, output tension $t_o$ being dependent upon the amount of restraining torque that is applied to the traction cylinder. The restraining torque may be increased up to but not equal to a value that results in the output tension equalling $t_i e^{\mu b}$ at which point the filament slips over the cylinder which has now become locked. If we wish to develop this traction cylinder or roller into a reciprocating filament actuator, we are naturally restricted to an angle of wrap $b < 2\pi$.

To add to or solely supply some inital tension $t_i$ we may utilize a second contacting press roller or a fixed pressure bar to supply some intial normal force F and hence initial tension $\mu f$ on the filament. The rolling or sliding friction indicated by this normal force inherently adds to the restraining torque acting on the traction cylinder. Hence as long as the condition $t_i < t_o < t_i e^{\mu b}$ is satisfied we have the filament gripping the traction roller and rotating it against a resisting torque. Where a press bar or roller is used to bear against the traction roller to enhance initial tension the condition of operation becomes $\mu f + t_i < t_o < (t_i + \mu f) e^{\mu b}$.

Thus, it will be understand that if a filament displacement means is positioned on a free sliding, traversing shuttle such that the traction roller input and output filament paths are axially displaced, the filament will outline a helix on the traction roller. By reacting against the high tension output filament, the shuttle will be continuously advanced, maintaining a constant helix angle of the filament about the traction roller. By utilizing a method whereby the lead between the output and input filament is reversed at the ends of the desired traverse, the guide will reciprocate between these limits.

In accordance with the invention, there is provided a filament guide for use in helical filament winding operations wherein a filament is drawn by a driven form or mandrel on which the filament is to be wound. The guide comprises a traction roller about which, in operation, the filament to be wound is drawn to rotate the roller, against a reaction torque. A means is provided which contacts the filament in order to axially displace the filament on the traction roller a predetermined amount with respect to filament input and filament output paths, thereby defining the helix angle of wrap on the form. This filament contact means is moveable, under force as applied thereon by the filament leaving the roller, non-rotatively between predetermined limits in a direction parallel to the axis of the roller. The guide further comprises means to reverse the axial displacement of the filament when the filament axial displacement means reaches the predetermined limit in each direction, thereby defining the limits of movement of the filament axial displacement means and, as well, the limits of the filament winding on the form.

In a preferred embodiment for wet filament winding, the filament contact means comprises a shuttle mounted on the traction roller for movement in the axial direction between predetermined positions. Preferably made out of wire or tube form the shuttle has filament input slots axially spaced a predetermined distance. During operation, the input path of the filament being fed to the traction roller normally passes through one or other of these filament input slots. The shuttle also has a filament output slot through which the output path of the filament leaving the traction roller passes. The filament output slot is positioned between the filament input slots, but out of linear alignment therewith. The shuttle is constructed such that, during operation there is a free and unconstricted path for lateral passage of the filament between filament slots. It is preferred that the filament output slot be centrally positioned between the filament input slots for equal helical wrap angles in both directions.

To those skilled in designing mechanisms, numerous configurations of this invention will become apparent. In dry systems with a high traction surface on the traction roller, a simple $\pi$ angle wrap with a traverse mounted sliding shuttle mounted for movement a linear shuttle slide spaced from the traction roller may be suitable. If a traction coefficient of $\frac{3}{8}$ was achieved, this configuration could operate at a tension muliplier ($e^{\mu b}$) of 3.25. If the friction and abrasion between the filament and wire form guide at filament input and output slots were to high, roller means may be provided at these slots. If greater traction were needed a separate press roller might be employed to raise the available initial $t_i$ and thereby increase the practical $t_o$ level. In wet systems, this basic two roller configuration might be modified by designing the shuttle to slide on the wet traction roller as a hydrodynamic journal bearing and thereby remove the necessity of a separate linear shuttle slide.

It will be understood that the helical winding filament guide according to the present invention yields uniform windups of the desired helix angle in a greatly simplified manner due to the inherent characteristics of the invention:

the helix angle is fixed solely by shuttle configuration and is independent of mandrel dimensions such as diameter and length;

the unit has an infinite range and can be readily adjusted, even while running, to shorten or lengthen the windup;

the filament is wound up at a high speed and achieves a uniform thickness due to the independent statistically random nature of the windup;

the device permits steady tension on rolled up filaments; and a single torque controlled traction roller and simple lightweight shuttle replaces conventional complicated machinery.

BRIEF DESCRIPTION OF THE DRAWINGS

These and other advantages and features of the invention will be understood by referring to the drawings in which.

Figure 1:
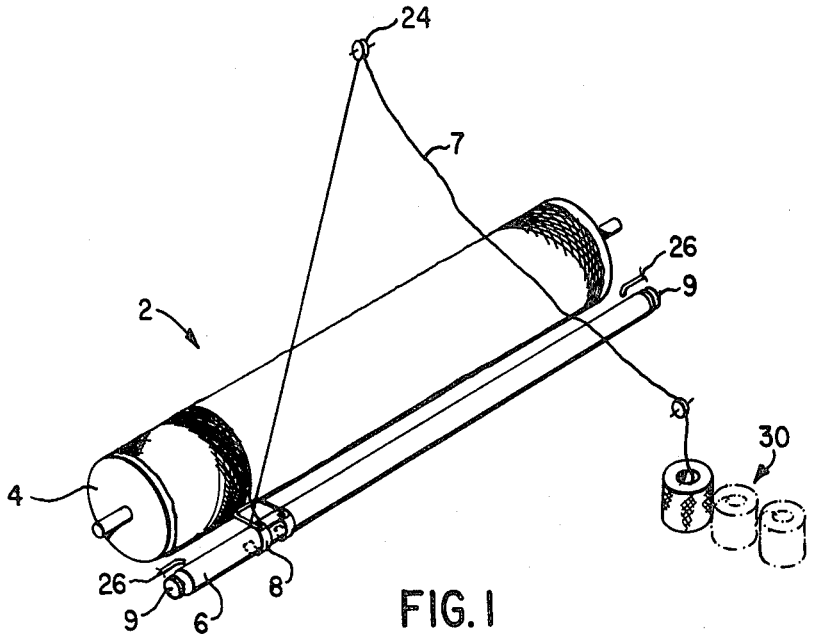
FIG. 1 is a perspective view of the filament guide according to the present invention mounted on a traction roller and operating to wet wind a filament pipe on a cylindrical mandrel.

While the invention will be described in connection with an example embodiment, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to FIG. 1 there is shown a filament guide 2 for use in helical filament winding of mandrel 4. The guide comprises a traction roller 6 about which filament 7 is drawn. On traction roller 6 is seated shuttle 8 free to move axially, side to side on roller 6. Thrust bearings 9 are located at the sides of traction roller 6.

Figure 2:
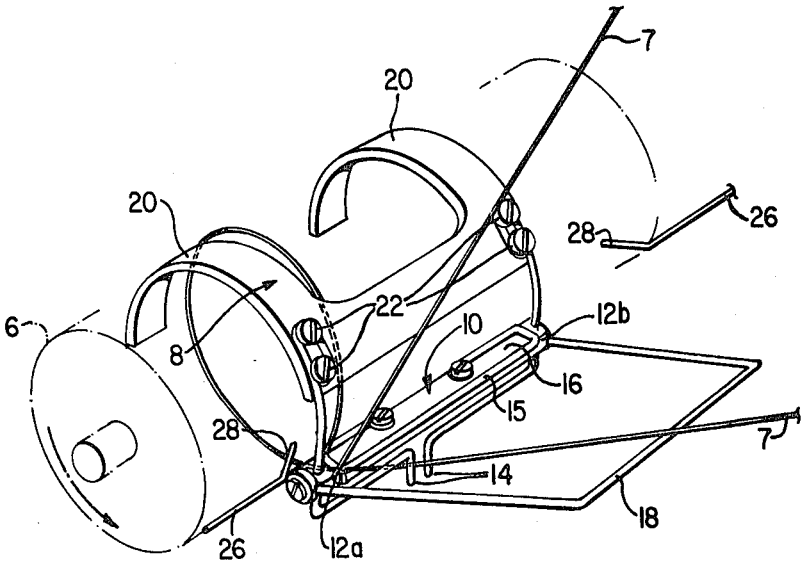
FIG. 2 is an enlarged detail view of the filament guide of FIG. 1.
Figure 3:
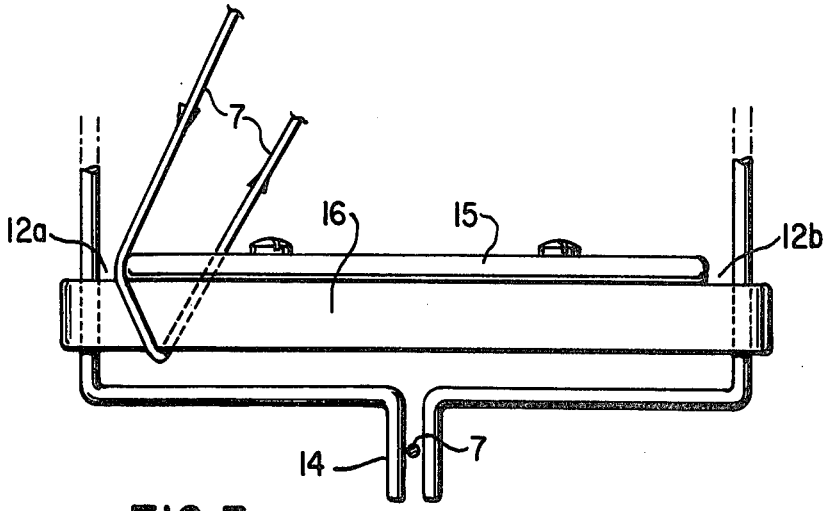
FIG. 3 is a front, detail view of the filament output slot of the filament guide of FIG. 1.
Figure 4:
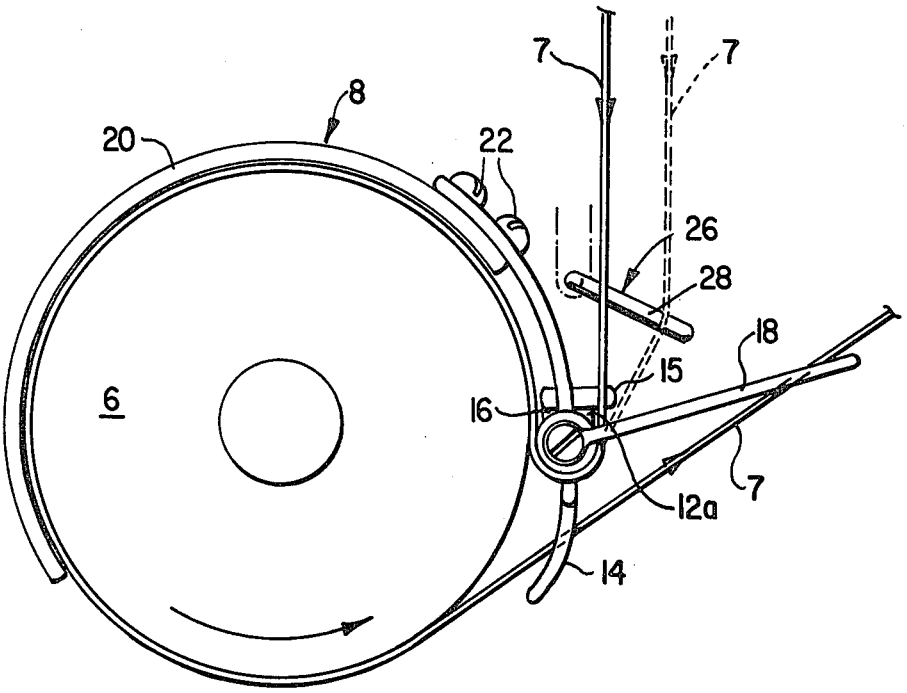
FIG. 4 is a side view of the filament guide of FIG. 2.

As can be seen in FIGS. 2 and 4, shuttle 8 has secured thereto a form 10 defining filament input slots **12*a* and 12*b* through which the input path of filament 7 being fed to the traction roller 6 normally passes during operation, and filament output slot 14 positioned centrally between the filament input slots 12*a* and 12*b* but out of alignment therewith. The output path of filament 7 leaving traction roller 6 passes through output slot 14 (FIGS. 2 and 3). It will be noted from FIG. 2 that there is a free and unconstricted path for lateral passage of filament 7 between filament input slots 12*a* and 12*b* along filament gate 15**.

Additionally secured to shuttle 8, to bear against the surface of traction roller 6 is press bar 16 the function of which, as will be explained in more detail subsequently, is to ensure higher output tension than input tension on filament 7 passing about traction roller 6. Additionally, torque reaction arm 18 is secured to shuttle 8, against which arm, during operation, filament 7 bears after it has left traction roller 6 to maintain the angular position of shuttle 8.

It will be noted in FIGS. 2 and 4 that filament 7 is drawn by the rotating mandrel 4 through filament input slot **12*a*, about press bar 16 and about the surface of traction roller 6, then leaving the surface and passing through output slot 14. The drawing of filament 7 about the surface of roller 6 causes the roller to rotate as long as the retarding torque does not exceed a critical value. Input slot 12*a* and output slot 14 ensure a predetermined axial displacement of filament 7 as it is drawn about traction roller 6, so that the path of the filament 7 on traction roller 6** defines a helix of predetermined helix angle.

The shuttle is secured to the traction roller 6 by means of low pressure hydrodynamic bearing arms 20 made from a 180° tube saddle milled to be slightly oversized, thereby providing minimum resistance as it slides laterally on the lubricated surface of traction roller 6 during operation. Adjusting screw 22 permits adjustment of pressure exerted on traction roller 6 by press bar 16, as will be readily understood.

It will also be noted from FIG. 1 that the filament before it passes onto traction roller 6 is placed under some slight initial tension as it passes central payout 24 positioned on a line approximately halfway between the ends of travel of shuttle 8 and at such a distance so that the maximum angle of the filament with that line is larger than the operating helix angle.

As seen in FIG. 2, trigger mechanism 26 is secured to the frame of the filament guide at each end of the traction roller 6, each trigger mechanism having an abutment surface 28, positioned with respect to the filament input path for each filament input slot 12*a* and 12*b* so that filament 7 will bear against the corresponding abutment surface and become removed from that slot during operation, and directed into the filament path between filament input slots when shuttle 8 reaches the limit of its movement in that corresponding direction.

In operation, filament to be wound on mandrel 4 is drawn from a source 30 through central payout 24 and about traction roller 6 through shuttle 8, as shown in FIG. 2, rotating roller 6. With the filament passing onto the surface of traction roller through input slot 12*a* and off of that surface through output slot 14, the filament is axially displaced to the right as it is drawn about traction roller 6. Since filament 6 is drawn under tension by rotating mandrel 4, shuttle 8 is drawn by the tension of filament 7 to the left, until the filament, along its input path, bears against trigger abutment surface 28, as shuttle 8 reaches the end of its run along traction roller 6 to the left. At that point, the filament along its input path is lifted from input slot 12*a* and, upon clearing slot 12*a*, slips along filament gate 15, under tension until it slides into input slot 12*b*. It will be understood that, in this way, the axial displacement of filament 7 about traction roller 6 becomes reversed, and the shuttle is then drawn to the right along traction roller 6 under tension of the filament as it leaves the surface of traction roller 6. When the shuttle reaches the end of its run to the right on traction roller 6, the filament along its input path is then dislodged from its position within input slot 12*b* by action of abutment surface 28 on the other filament trigger 26. In this manner, the shuttle is continuously advanced back and forth within predetermined limits on the traction roller, maintaining a constant helix angle about the traction roller and thereby producing a similarly constant helix angle of wrap of the filament on mandrel 4 within the predetermined limits of winding.

It will be understood that the system as illustrated in FIGS. 1, 2, 3 and 4 is designed for lubricated wet winding, i.e. the filament is for example a glass fibre wetted with a relatively low viscosity resin.

Dependent upon the nature of the particular filament (wire, glass fibre roving, textile yarn, etc.), various traction surfaces on traction roller 6 may be applied (e.g. elastomers, plasma-sprayed ceramics, etc.). For helical winding of continuous filament reinforced composites, it is believed that the most desirable roller coatings are elastomers, since they permit resin squeeze rollout without fragmentation of the filaments, give a high traction coefficient with wet tensioned filaments, and provide a compliant surface providing enhance hydrodynamic stability to the shuttle bearing surface, as well wider manufacturing tolerances are possible due to their compliant nature. The structural traction tubes may be formed by pultrusion or be helically filament wound.

The journal bearing shuttle illustrated in FIGS. 1 to 4, mounted around the lubricated compliant elastomer coated roller 6 is a basic configuration of the present invention. Press bar 16 is smooth and mounted on the shuttle to provide sufficient normal force for the wet output filament tension. This normal force is counterbalanced by the hydrodynamic bearing area. All induced radial torques such as press bar sliding friction and bearing viscous shear are counterbalanced by the extended torque reaction arm 18 that maintains the shuttle's angular position by radially bearing against the high tension output filament. Restraining torque may additionally be supplied to the roller shaft to achieve the desired output tension, for example, by way of a hysteresis brake, a friction disc, a hydraulic gear pump-controllable orifice combination of generator-load combination. Indeed, for guides designed to operate with high shuttle speeds, the major component of restraining torque may come from for example, a hysteresis brake system acting on roller 6 and supplying constant and controllable reaction torque to the traction roller from 0 to operating speed. In such a system, press bar 16 would function primarily to provide a sufficient angle of wrap for the filament about roller 6.

Figure 5:
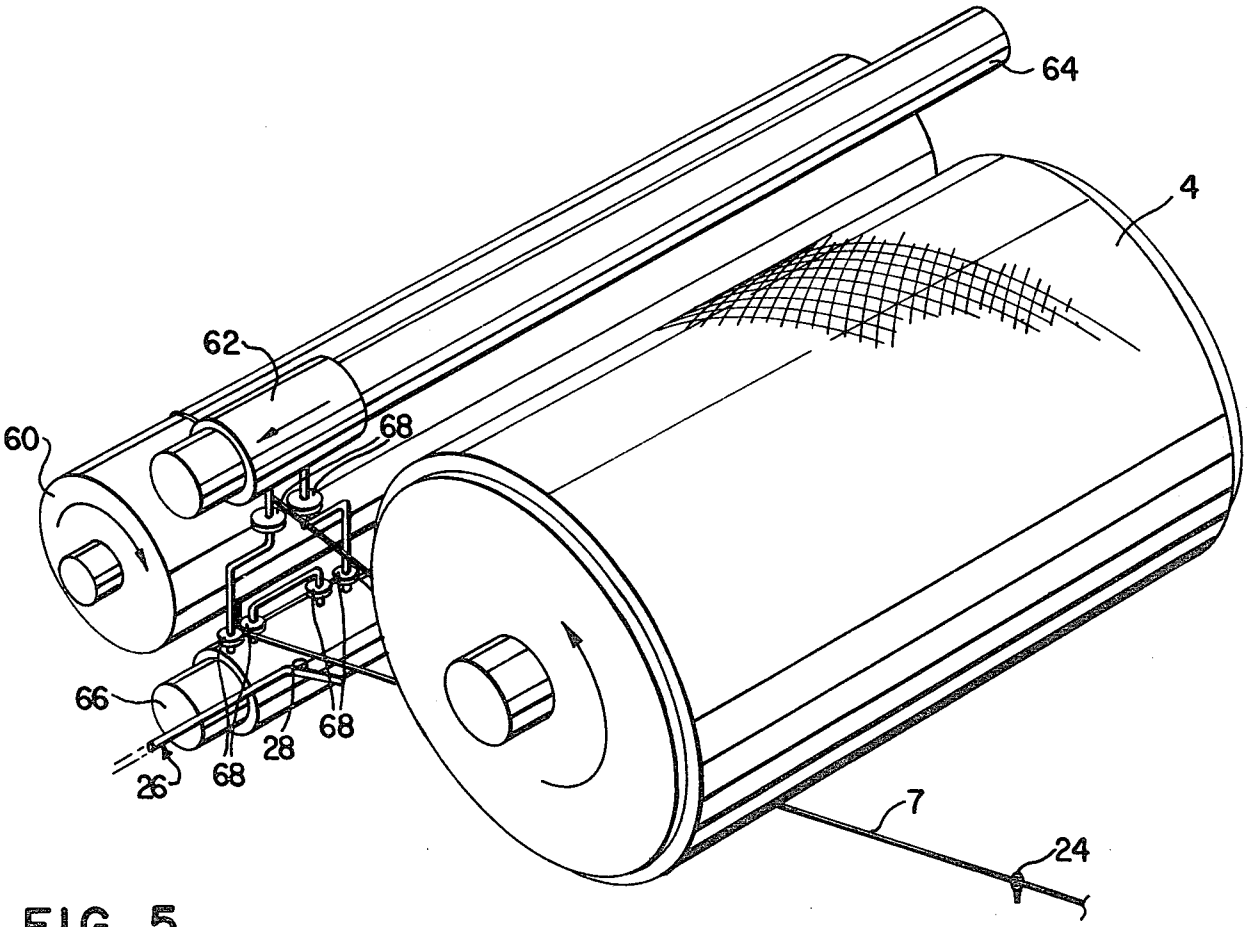
FIG. 5 is a perspective view of a filament guide according to the present invention constructed for helical winding of dry or high viscosity prepreg filament.

In FIG. 5 there is illustrated a system for winding dry, or high viscosity prepreg filament 7 using a high traction surface on roller 60. In this embodiment, sliding shuttle 62 moves between predetermined limits on linear slide bars 64 and 66, the limits of movement thereon being again determined by filament trigger mechanism 26. Again where friction between filament and the input and output slots is too high, rollers 68 may be utilized at these locations as filament guides.

The hardness of the elastomer coating on the traction roller plays a critical part in determining the achievable coefficient between the traction roller surface and the tensile filament. From simple 180° tensile tests it was found that the overall coefficient of friction varied from $\frac{1}{4}$ to 1 between dry glass roving and thermoset urethane elastomer of 90 and 60 SHORE A DUROMETER hardness respectively. Dry prepreg roving had an equal traction effect. Impregnation with wet low viscosity resins generally reduced the traction levels by $\frac{1}{3}$. Thus with the softer urethane coatings (e.g SHORE A=60) wet winding tension multipliers of about 30 when the angle of wrap $b=1.75\ \pi$ can consistently be reached.

Therefore with the relatively softer elastomer coatings when we wish to wind wet filaments at high speed the press bar utilizes only a very slight pressure and serves mainly to maximize the angle of wrap, the constant reaction torque being supplied by, for example, a hysteresis brake.

It should be noted that as long as a high tension multiplier is achieved in wet winding the angle of wrap may be reduced to lower levels (e.g. $1.75\ \pi \rightarrow \pi$.)

It will be readily understood that the filament guide according to the present invention provides a constant helix angle irrespective of the mandrel or package diameter. This feature allows one shuttle to wind pressure pipe of various and variable diameters without operator adjustment or complicated gearing. It also inherently provides for the dwell required when winding closed end vessels such as isentoid or hemispherical end surfaces with polar ports. The random positioning of the filaments assures an even thickness of windup, without the critical non-integer ratio requirements of standard geared reciprocating guide systems. As well, the infinite range feature of the reciprocating guide according to the present invention allows quick and sensitive adjustments of roving package or filament wound pipe lengths. The device according to the present invention can replace several functions (impregnation-resin roll out-roving tensioner-geared reciprocating guide) with a straightforward apparatus consisting solely of a controlled retarding torque traction roller and a simple shuttle. The device can operate at high speed because of its relatively low reciprocating shuttle mass.

Applicant's device is useful for winding textile filaments, the filament winding of continuous reinforced composites, winding of prepeg roving, building of glass fibre wound piping used for example for non-corrosive conduits, chemical piping and the like, to mention only a few of the applications. Moreover, when tension on filament 7 terminates, the entire apparatus stops, i.e. the device runs only when the filament is pulled along its output path.

Thus there has been provided in accordance with the invention a method and apparatus for use in helical filament winding operations that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What I claim as my invention is:

1. A filament guide for use in helical filament winding operations wherein a filament is drawn by a driven form on which the filament is to be wound, comprising a traction roller having a rotational axis about which, in operation, the filament to be wound is drawn to rotate the roller, the angular contact of the filament with the exterior surface of the traction roller, during operation, being less than $2\pi$ radians; filament contact means contacting the filament to provide axial displacement of an input path of the filament to the traction roller from an output path of the filament from the traction roller by a predetermined amount, whereby the helix angle of wrap of the filament on the form is defined by a force applied in a direction parallel to the rotational axis of the roller by the filament leaving the roller; and means to reverse the direction of the axial displacement of the input and output paths of the filament when the filament contact means reaches predetermined limits, thereby defining the limits of movement of the filament contact means and as well the limits of filament winding on the form.

2. A filament guide according to claim 1 adapted for wet winding filament operations wherein the filament contact means is mounted on the traction roller for non-rotative movement parallel to the rotational axis of the roller between predetermined limits.

3. A filament guide according to claim 1 wherein the filament contact means comprises a shuttle mounted on the traction roller for movement between predetermined positions, the shuttle having two filament input slots axially spaced by a predetermined distance, the input path of the filament, during operation, being fed to the traction roller normally passing through one of the filament input slots, the shuttle further having a filament output slot through which the filament passes after leaving the traction roller, the filament output slot being positioned between the filament input slots, but out of linear alignment therewith, the shuttle having an unconstricted path for passage of the filament from one input slot to the other input slot.

4. A filament guide according to claim 3 wherein the means to reverse the axial displacement of the input path of the filament with respect to the output path of the filament comprises abutment surfaces, one abutment surface being positioned with respect to the filament input path for each filament input slot so that the filament will bear against a respective one of the abutment surfaces and become removed from a respective slot when the shuttle reaches a predetermined limit of its movement in that corresponding direction, input filament tension means being provided to ensure sufficient tension on the filament before it passes onto the traction roller to move the filament from one of said input slots to the other of said input slots after said filament has been removed from one of said slots.

5. A filament guide according to claim 3 wherein the filament input and filament output slots are defined by a wire.

6. A filament guide according to claim 3 wherein the filament input and filament output slots are defined by rollers, whereby friction or abrasion of the filament as it passes through the slots is reduced.

7. A filament guide according to claim 3 wherein the filament output slot is centrally positioned between the filament input slots.

8. A filament guide according to claim 7 wherein the shuttle additionally is provided with a wire torque reaction arm against which, during operation, the filament bears after it has left the traction roller to maintain the angular position of the shuttle.

9. A filament guide according to claim 1 wherein the filament contact means moves between predetermined limits on linear slide means spaced from the traction roller and positioned parallel to the axis of rotation of the traction roller.

10. A filament guide according to claim 9 wherein the filament contact means comprises a shuttle mounted for longitudinal movement on the linear slide means, form means on said shuttle means defining two filament input slots spaced in the direction of longitudinal movement of the shuttle is predetermined distance, the path of the filament being fed to the traction roller normally passing through one of the filament input slots, the form means further defining a filament output slot through which the filament passes when leaving the traction roller, the filament output slot being centered between the filament input slots but out of linear alignment therewith, the form means providing a free and unconstricted path for lateral passage of the filament between the filament input slots.

11. A method of helically winding a filament on a driven form comprising the steps of:

wrapping the filament around a traction roller before the filament engages said form, so that said roller is driven by the filament, causing the filament to be helically wrapped around the traction roller to thereby cause the filament to move along a rotational axis of said driven form, in accordance with the helical angle of the filament about the traction roller.

12. The method of claim 11 further comprising the step of reversing the direction of the helical wrap of the filament about the traction roller at a predetermined position of said filament on said driven form.

* * * * *